US005129705A

United States Patent [19]

Wray

[11] Patent Number: 5,129,705

[45] Date of Patent: Jul. 14, 1992

[54] HEAD SUPPORT

[76] Inventor: Thomas E. Wray, 399 Main Street, Schomberg, Ontario, Canada, L0G 1T0

[21] Appl. No.: 772,607

[22] Filed: Oct. 8, 1991

Related U.S. Application Data

[63] Continuation of Ser. No. 492,105, Mar. 12, 1990, abandoned.

[30] Foreign Application Priority Data

Dec. 19, 1989 [CA] Canada ..... 2006053

[51] Int. Cl.[5] ..... A47C 7/38

[52] U.S. Cl. ..... 297/397; 5/636

[58] Field of Search ..... 297/391, 397, 410, 464, 297/DIG. 2; 5/434, 440

[56] References Cited

U.S. PATENT DOCUMENTS

| | | | |
|---|---|---|---|
| 2,582,571 | 1/1952 | Thoma | 297/397 |
| 3,062,586 | 11/1962 | Rowland . | |
| 3,537,750 | 11/1970 | Lohr | 297/410 |
| 4,030,781 | 6/1977 | Howard . | |
| 4,114,948 | 9/1978 | Perkey . | |
| 4,166,459 | 9/1979 | Nightingale | 5/440 X |
| 4,565,405 | 1/1986 | Mayer | 297/230 |
| 4,738,488 | 4/1988 | Camelio . | |
| 4,838,611 | 6/1989 | Talaugon | 297/391 |

FOREIGN PATENT DOCUMENTS

| | | | |
|---|---|---|---|
| 2208793 | 4/1989 | United Kingdom | 297/464 |

*Primary Examiner*—Peter R. Brown
*Attorney, Agent, or Firm*—Barry R. Lipsitz

[57] ABSTRACT

A headrest for supporting a person's head comprising a semi-rigid formed pillow element having two similar, spaced apart side sections and a central section connecting these side sections. The front of each side section is convexly curved in a horizontal direction and the side sections have a height substantially greater than the height of the central section which extends between the lower halves of the side sections. The headrest is manufactured by joining two layers of cloth material to opposite sides of a sheet of dual density polyethylene by flame lamination. The combined material is thermally molded into the headrest.

14 Claims, 3 Drawing Sheets

HEAD SUPPORT

This application is a continuation of U.S. patent application Ser. No. 07/492,105, filed Mar. 12, 1990, now abandoned.

BACKGROUND OF THE INVENTION

This invention relates to a headrest for supporting a person's head.

The use of a headrest permanently affixed to the top of a vehicle seat and perhaps adjustable with respect thereto is known but such headrests are not suitable for some applications. For example, because the headrest is attached to the top of the seat back, it is generally too high to support the head of a child using the seat. Also many headrests in vehicles are not particularly suitable for sleeping or even resting since they are designed simply to provide a head support while the car is being driven. Thus headrests are often provided for a driver's seat but clearly the driver must remain awake and alert at all times.

Sometimes an ordinary pillow is used to support a person's head so that he or she can rest but there are known difficulties associated with the use of soft pillows. Thus there is generally no means for supporting the pillow at an elevated position on the seat back. Furthermore, it is often necessary to position the pillow to one side of the seat back in order that the user's head will be supported both from the rear and from the side while he or she is sleeping. By positioning a pillow in this manner, the position of the person using it is often uncomfortable and its use may result in poor posture.

Various forms of adjustable headrests designed for use in a vehicle have been proposed. For example, U.S. Pat. No. 4,738,488 issued Apr. 19, 1988 to Carol Camelio describes an adjustable headrest which can either be fastened to the back of an automobile seat or used in a folded over position. This headrest has an elongated tab with a fastener to hang the adjustable headrest from the back of the seat.

U.S. Pat. No. 3,062,586 issued Nov. 6, 1962 to Thomas Rowland describes a combined head and back rest that has a reversible back rest panel and an upward extension on the panel. A flexible attaching member is secured to the upper edge of the extension and a pillow is connected to this member. The pillow may be positioned selectively on opposite sides of the extension.

It is an object of the present invention to provide a headrest of simple construction that can easily be used on most car seats and that provides good support for a person's head.

The present headrest can be attached to a vehicle seat back without damaging the seat back in any way and furthermore the height of the headrest is adjustable in the preferred version thereof.

SUMMARY OF THE INVENTION

According to the present invention, a headrest to support a person's head while the person is seated upright in a seat having a seatback comprises a semi-rigid, formed pillow element having two similar, spaced-apart side sections and a central section connecting these side sections. The front of each side section is convexly curved in a horizontal direction. The height of the side sections is the vertical dimension when the headrest is placed in its operative position against the seat-back to support the head. The height of the side section is substantially greater than the height of the central section. The central section extends between lower halves of the side sections when the headrest is held in an upright position for use on the seat back. There are means for detachably mounting the pillow element on the seat-back so that it rests directly against the front of the seat-back and is supported at the rear by the seat-back. The mounting mechanism is connected to a rear surface of the pillow element.

Preferably, the central section forms a concave curve in a horizontal plane extending centrally through the central section when the headrest is in the upright position.

According to another aspect of the invention, a headrest to support a person's head while the person is seated upright in a seat having a seat-back comprises a formed, semi-rigid pillow having two spaced-apart side sections and an integral central section connecting the side sections together in spaced relationship. There are also elongate straps for detachably mounting the pillow on a seat back so that the pillow rests directly against the seat-back and is supported at its rear by the seat-back. These straps are capable of extending around the top of the seat back and have fastening means affixed on ends thereof for adjustably connecting the pillow to permit the pillow to be raised or lowered relative to the seat back.

Preferably, the fastening devices comprise elongate multiple hook fastening strips extending along end portions of the straps.

Further features and advantages will become apparent from the following detailed description taken in conjunction with the accompanying drawings.

DETAILED DESCRIPTION OF THE DRAWINGS

Figure 1:
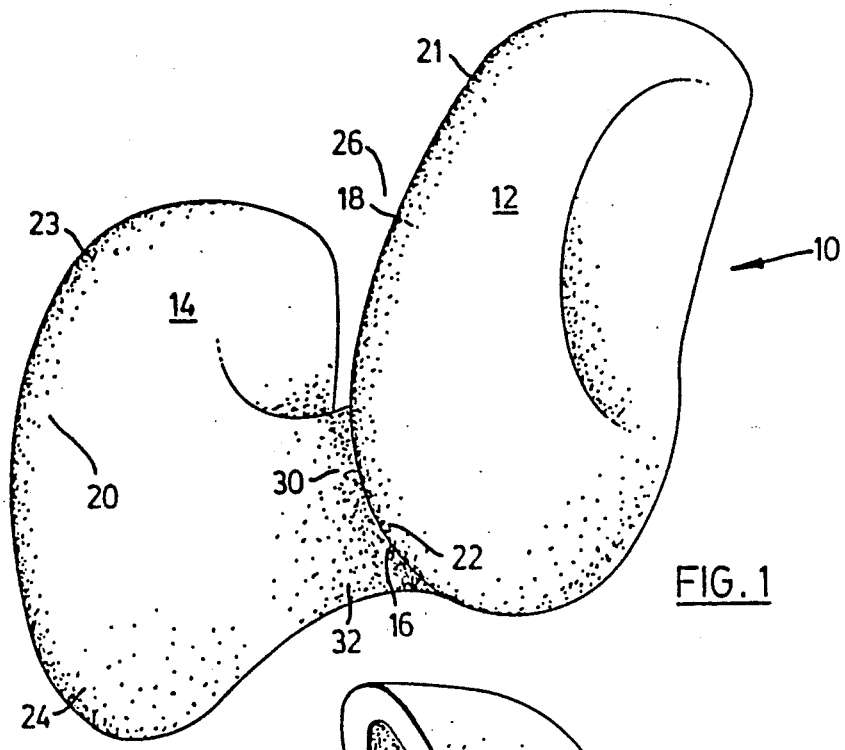
FIG. 1 is a perspective view taken from the front and bottom showing a headrest constructed in accordance with the invention.
Figure 2:
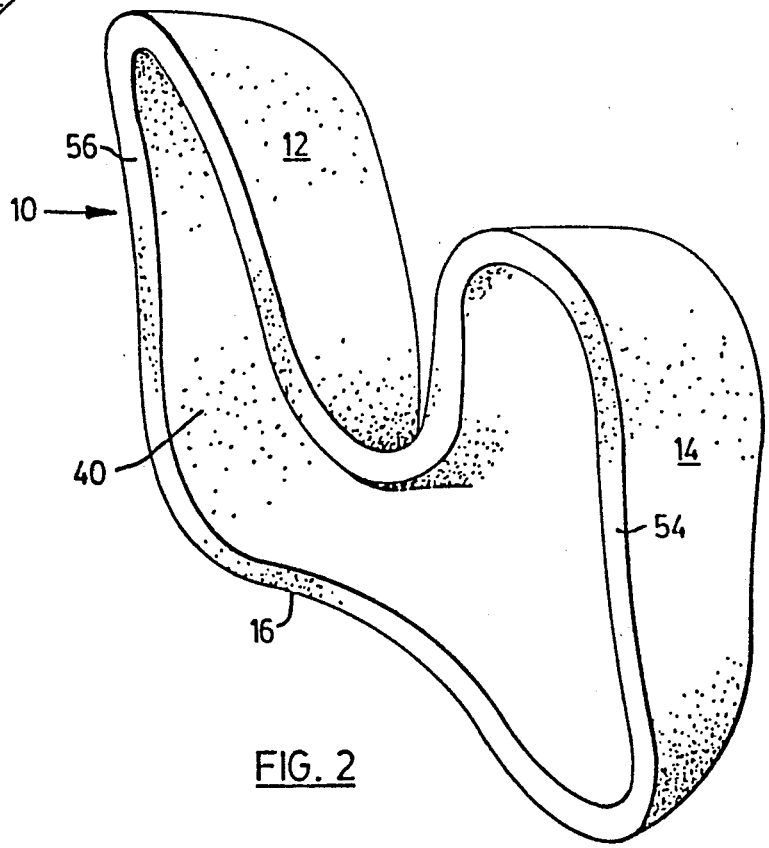
FIG. 2 is another perspective view taken from the rear and top and showing the headrest of FIG. 1.
Figure 3:
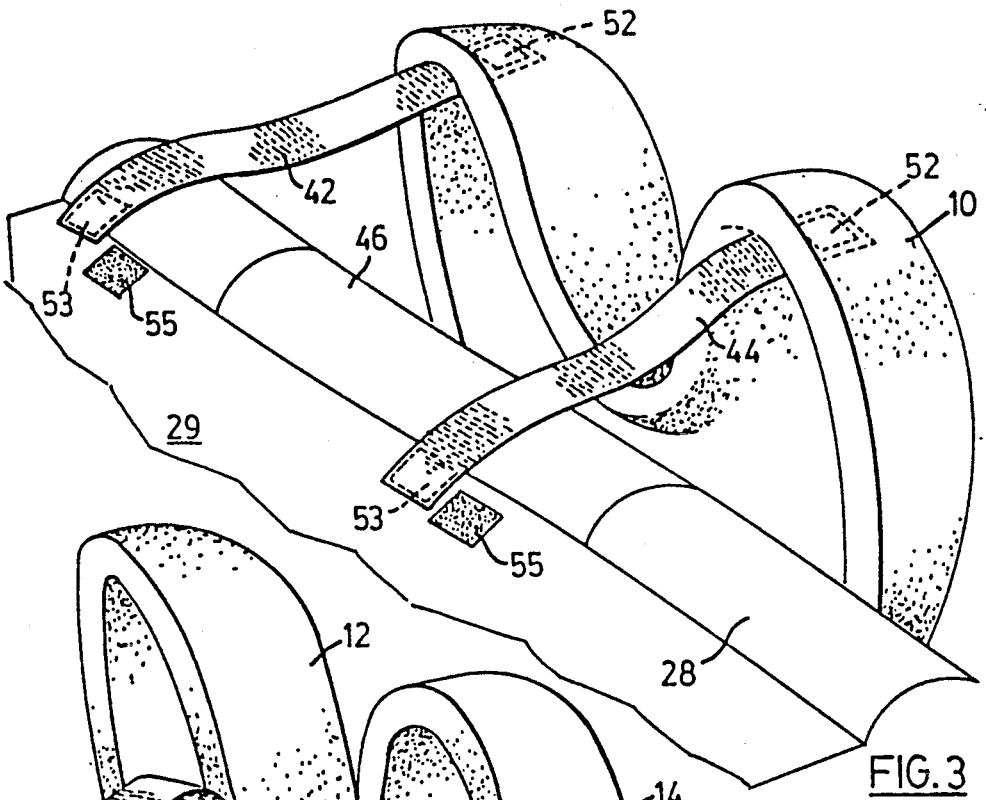
FIG. 3 is a perspective view of the headrest taken from the rear and top showing the use of straps to detachably mount the headrest to a parcel shelf located behind a seat back.

A headrest constructed in accordance with the invention and designed to support a person's head while he or she is seated is shown in FIGS. 1 and 2. The headrest 10 comprises a semi-rigid formed pillow element having two similar, spaced apart side sections 12 and 14. The headrest also has a central section 16 connecting the side sections. The front of each side section is convexly curved in a horizontal direction at 18 and 20 so as to provide a smooth comfortable surface for resting a person's head. The side sections are also convexly curved at the front in the vertical direction as indicated at 21-24. The side sections 12 and 14 have a height substantially greater than the height of the central section as shown clearly in FIG. 2 of the drawings. The central section 16 extends between lower halves of the side sections when the headrest is held in an upright position for use as in FIG. 3. It will thus be seen that the headrest 10 forms an open area or cavity 26 which accommodates the user's head. Thus the head will rest directly against a seat back 28 on which the headrest is mounted. The back of the users neck rests comfortably against the central section 16 whose depth is much less than that of the side sections. It will be appreciated that the head is supported on either side by the side sections 12 and 14 and thus will not be allowed to tip too much to either side.

In order to provide a smooth and comfortable support for the back of the neck, preferably the central section forms a concave curve located at 30 in FIG. 1. This concave curve is in a horizontal plane extending centrally through the central section when the headrest is in the upright position.

In one preferred embodiment of the headrest, the total height of each side section is about 9¼" while the height of the central section 16 at its narrowest point is 2¾". The bottom of the headrest forms a concave curve at 32 and the total depth of this curve measured from a line extending between the bottommost points of the side sections is 1¼". The height of the gap 26 to be formed between the side sections is approximately 5".

Figure 5:
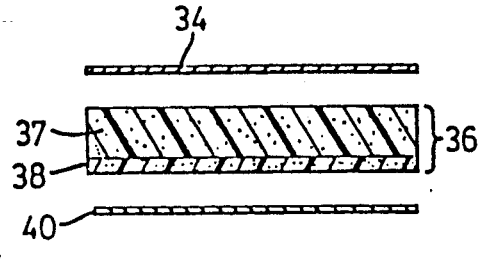
FIG. 5 is an exploded edge view showing the separate layers used in the construction of the headrest of FIGS. 1 and 2.

Turning now to the materials from which the headrest 10 is constructed, the layers of material used are illustrated in FIG. 5. Preferably, there is a soft cloth material 34 such as terrycloth, covering the front surface of the headrest. This material and the headrest itself can be washed so that the headrest can be kept clean for repeated use. The semi-rigid central portion of the headrest is formed by crosslink polyethylene. Preferably, this polyethylene is a dual density layer 36. In one preferred embodiment of the headrest, there is a layer of two pound polyethylene having a thickness of ⅜" indicated at 37 in FIG. 5 and a layer of seven pound polyethylene having a thickness of ⅛" located at 38. These two layers 37 and 38 are firmly bound together as a single dual density layer. The low density polyethylene at 37 is located adjacent the front surface of the headrest to provide a very comfortable surface that is highly resilient. The much higher density polyethylene layer 38 has the necessary rigidity to permit the headrest to keep its shape under normal use. Preferably, the rear surface of the headrest is covered with a reasonably strong fabric layer, the preferred material being brushed nylon fabric 40. The rear cloth layer helps to provide a protective covering for the polyethylene and improves the appearance of the headrest, the rear of which can be seen since the headrest is generally detachable from the supporting seat back. In addition as explained hereinafter, if a suitable cloth fabric such as brushed nylon is employed, the rear layer of cloth can provide a means for detachably connecting the headrest 10 to straps used to detachably mount the headrest on a seat back.

Strong flexible straps 42 and 44 can be used to detachably mount the pillow or headrest 10 either on the seatback 28 or on a parcel shelf 29 which is often located behind the rear seats of a vehicle. The preferred straps are made from a strong woven material such as nylon. In a preferred embodiment, the straps are approximately 15 inches long. The straps could extend either over the top 46 of the seatback or, in the case of a bucket seat, around the sides of the seatback. Preferably one end of each strap is provided with a multiple hook fastening strip or patch 52 indicated in dashed lines in FIG. 3. These strips or patches can be the type sold under the trade mark VELCRO.

The opposite ends of the straps are preferably provided with multiple hook fastening strips or patches 53 as well. These patches 53 can be used to secure the ends of the straps to suitable multiple loop fastening strips or patches 55 securely attached to either the rear of the seatback or to the top of the parcel shelf as shown. In some vehicles the multiple loop fastening patches 55 may not be necessary as the seat upholstery or the fabric on the top of the parcel shelf may be suitable for the direct attachment of the multiple hook fasteners.

Figure 4:
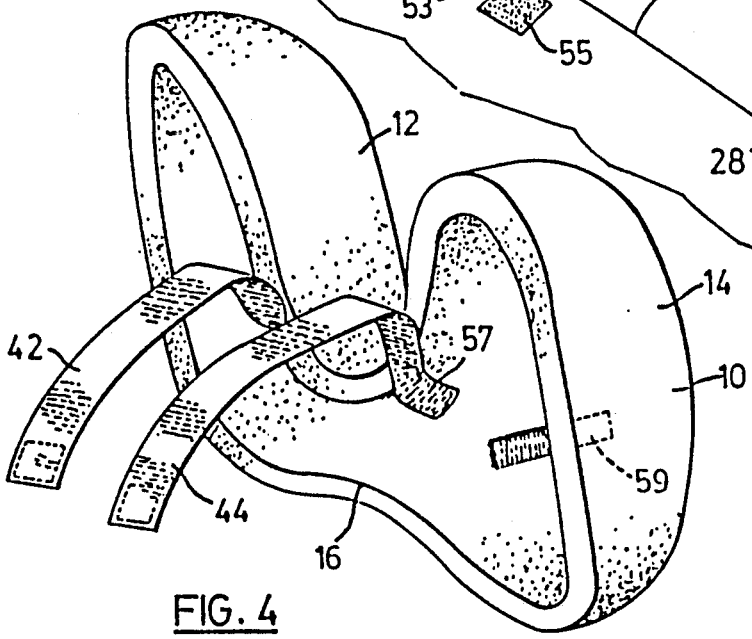
FIG. 4 is a perspective view of a headrest showing alternative locations for attaching the straps to the headrest.

It is relatively easy to adjust the height of the headrest on the seat back. This can readily be done by changing the position where the straps 42 and 44 are attached to the headrest. FIG. 4 illustrates two alternative positions for the attachment of the straps. For example, the ends of the straps can be attached to the headrest at opposite ends of the central section 16 as indicated at 57. By attaching the straps at this location, the headrest 10 is positioned higher on the seatback then it would be with the straps attached at the location shown in FIG. 3. When the straps are to extend around the side of a seat, such as a bucket seat, or around the sides of an existing headrest mounted on the seat, the strap ends can be attached at the location 59 shown in FIG. 4. In other words, the strap ends are attached to the central portion of the inside surfaces of the outer walls of the side sections 12 and 14.

It will be appreciated that the headrest 10 is very light in weight and this makes it very portable. Both the side sections 12 and 14 and the central section 16 are hollow as shown in FIG. 2. The headrest retains its desirable shape as a result of the thermal moulding of the cloth covered crosslink polyethylene.

Figure 6:
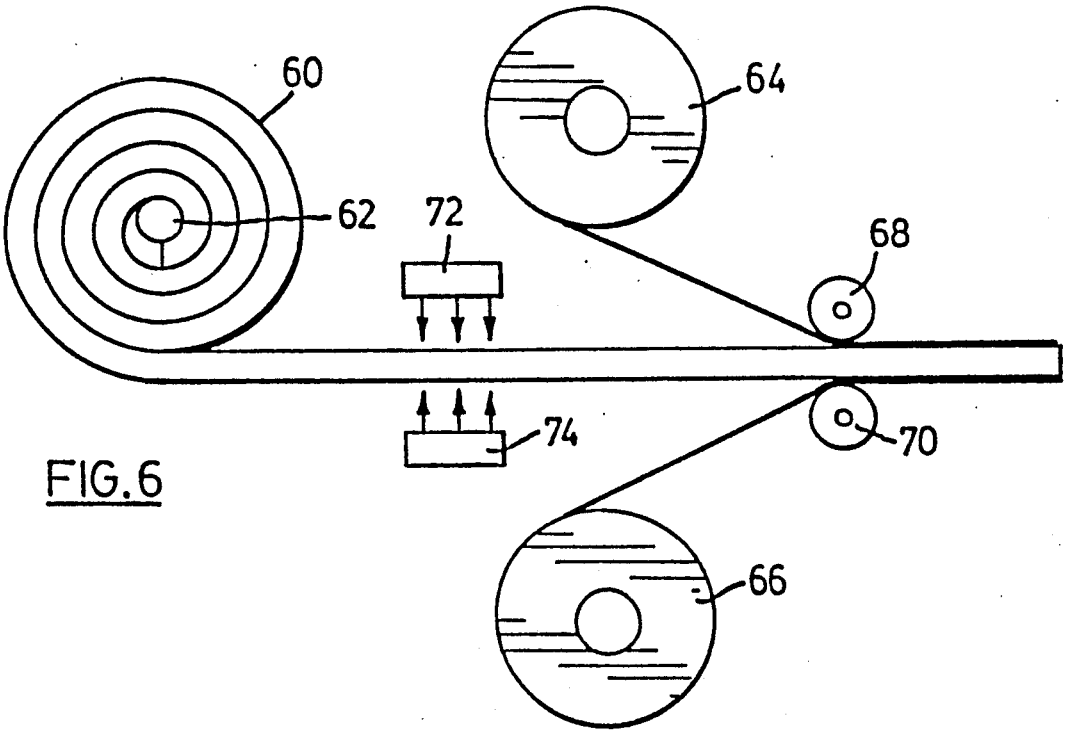
FIG. 6 is a schematic elevational view showing the preferred method for joining the layers of cloth material to polyethylene material, which combined material is used to construct the headrest of FIGS. 1 and 2.

The preferred method of manufacturing the headrest 10 will now be described with particular reference to FIGS. 6 and 7 of the drawings. The initial manufacturing step is illustrated in FIG. 6. This step comprises joining the inner and outer cloth layers to a sheet of crosslink polyethylene. A roll of crosslink polyethylene is provided at 60 and it is mounted on a suitable shaft 62. There are also provided a roll of terrycloth material at 64 and a roll of brushed nylon at 66. As the polyethylene material is drawn towards two pressure rollers 68 and 70, the polyethylene material is flame laminated on both sides by heating elements 72 and 74. These heating elements can use propane flame to provide the necessary heat. Both surfaces of the polyethylene are rendered tacky before they come into contact with the terrycloth and the brushed nylon. The terrycloth and the brushed nylon material are pressed via rollers 68 and 70 so that they both fuse to or bond to the polyethylene.

The next step in the manufacturing process is to cut the combined material into rectangles of suitable size to make the desired headrest. One preferred size is 15 by 20 inches. The rectangular sections can be formed by die cutting if desired. Prior to moulding, the composite rectangles are fed through an oven on a conveyor belt and are heated to about 150 degrees F.

Figure 7:
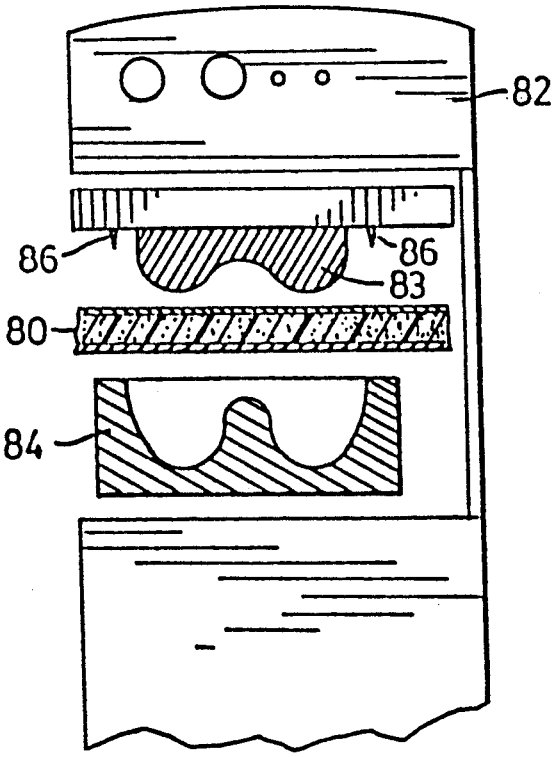
FIG. 7 is a schematic illustration of a mould press, partly in cross section, illustrating how the headrests are molded to the desired shape.

The final step in the manufacturing process is illustrated in FIG. 7 and comprises thermally moulding the combined material in a press 82 employing epoxy molds 83 and 84. Also mounted in the press is a cutting die 86 which trims off the excess material at the same time as the headrest is molded. The preferred form of headrest 10 has a mould draw of about 4 inches. The resulting headrest has side sections with a hollow interior having a maximum depth of at least 3 inches. It will be appreciated that side sections with this depth provide very good lateral head support, particularly for a child who would often have use for such a headrest.

It will be clear to those skilled in this art that various modifications and changes can be made to the illustrated and described headrest without departing from the spirit and scope of this invention. Accordingly, all such modifications and changes as fall within the scope of the accompanying claims are intended to be part of this invention.

I therefore claim:

1. A headrest to support a person's head while the person is seated upright in a seat having a seat-back comprising a semi-rigid, formed pillow element having two similar, spaced apart side sections engageable with opposite sides of the person's head and a central section connecting said side sections, the front of each side section being convexly curved in a horizontal direction, both side sections projecting substantially forwardly from the center of said central section in a normal, unsupported state of said headrest, the height of said side sections being their vertical dimension when the headrest is placed against said seat-back to support said head, said height of said side sections being substantially greater than the height of the central section, wherein said central section extends only between lower halves of said side sections to support a person's neck while allowing the back of the person's head to rest against said seat-back when the headrest is held in an upright position for use on said seat-back, and means for detachably mounting said pillow element on said seat-back so that said pillow element rests directly against the front of said seat-back with the central and side sections supported by said seat-back, said mounting means being connected to a rear surface of said pillow element wherein in a normal, unsupported state of said headrest, said central section forms a concave curve in a horizontal plane extending centrally through said central section when the headrest is in the upright position.

2. A headrest according to claim 1 wherein said pillow element is comprised mainly of crosslink polyethylene covered on the front thereof by a soft cloth material.

3. A headrest according to claim 1 wherein said mounting means comprises flexible strap means for detachably mounting said headrest.

4. A headrest according to claim 1 wherein said mounting means comprises two flexible straps, each of said straps having a multiple hook fastener strip secured thereon for adjustably connecting said pillow element.

5. A headrest according to claim 1 wherein said pillow element has a front surface covered with washable terrycloth.

6. A headrest according to claim 1 having front and rear surfaces covered by a cloth material, wherein said rear surface is covered at least in part with brushed nylon fabric.

7. A headrest according to claim 6 wherein said mounting means including multiple hook fastener strips that enable said pillow element to be adjustably secured to said mounting means, said fastener strips in use attaching to said nylon fabric.

8. A headrest according to claim 6 wherein said pillow element is comprised mainly of crosslink polyethylene and has front and rear surfaces both of which are covered by a cloth material.

9. A headrest to support a person's head while the person is seated upright in a seat having a seat-back, said headrest comprising a formed, semi-rigid pillow having two spaced-apart side sections and an integral central section connecting said side sections together in spaced relationship, both side sections projecting substantially forwardly from the center of said central section in the normal, unsupported state of said headrest, the height of said side sections being their vertical dimension when the headrest is placed against said seat-back to support said head, said height of said side sections being substantially greater than the height of the central section, wherein said central section extends only between lower halves of said side sections, elongate strap means for detachably mounting said pillow on a seat back so that the pillow rests directly against said seat-back with the central and side sections supported by said seat-back, said strap means being capable of extending around the top of said seat-back and having fastening means affixed on ends thereof for adjustably connecting said pillow to permit said pillow to be raised or lowered relative to said seat-back, wherein in a normal, unsupported state of said headrest, said central section forms a concave curve in a horizontal plane extending centrally through said central section when the headrest is in the upright position, to support a person's neck while allowing the back of the person's head to rest against said seat-back.

10. A headrest according to claim 9 wherein said fastening means comprise elongate multiple hook fastening strips.

11. A headrest according to claim 10 wherein said pillow has front and rear surfaces covered by cloth material, said rear surface being covered at least in part with brushed nylon fabric.

12. A headrest according to claim 10 wherein said pillow is comprised mainly of crosslink polyethylene covered on the front thereof by a soft cloth material.

13. A headrest according to claim 12 wherein said cloth material is washable terrycloth.

14. A headrest according to claim 9 wherein the front of each side section is convexly contoured in a horizontal direction and said side sections are hollow.

* * * * *